US006270195B1

(12) United States Patent
Wakahara et al.

(10) Patent No.: US 6,270,195 B1
(45) Date of Patent: Aug. 7, 2001

(54) IMAGE FORMING APPARATUS USING GATES AND ELECTRODES FOR SELECTIVELY PASSING TONER

(75) Inventors: Shirou Wakahara, Chiba; Hironori Ogasawara, Nara, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/188,765

(22) Filed: Nov. 9, 1998

(30) Foreign Application Priority Data

Nov. 10, 1997 (JP) ..... 9-306746

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125; 399/271, 290, 292, 294, 295, 329, 303

(56) References Cited

U.S. PATENT DOCUMENTS 5,874,973 * 2/1999 Wakahara ..... 347/55

FOREIGN PATENT DOCUMENTS 5-134581 5/1993 (JP) .

* cited by examiner

*Primary Examiner*—John Barlow
*Assistant Examiner*—Raquel Yvette Gordon
(74) *Attorney, Agent, or Firm*—Dike Bronstein Roberts & Cushman IP Group; David G. Conlin; David A. Tucker

(57) ABSTRACT

An image forming unit includes: a toner support for supporting the toner; an opposing electrode opposed to the toner support; a high-voltage power source for supplying a high voltage to produce a potential difference between the toner support and the opposing electrode; a control electrode having an insulative substrate disposed between the developer support and the opposing electrode, a plurality of gates formed in the insulative substrate for forming the passage of the developer, and electrode groups provided around a multiple number of the gates; and a control device for selectively applying multiple potential states to each electrode in the control electrode, wherein the control device controls the passage of the developer through the gates by applying the predetermined voltage to electrode groups so as to form an image on the surface of the paper which is being conveyed over the opposing electrode. In this configuration, a slanted portion for reducing the component of a force, acting on the toner residing on the paper, in the direction opposite to the conveyed direction of the paper, is provided on the downstream side of the opposing electrode.

5 Claims, 11 Drawing Sheets

IMAGE FORMING APPARATUS USING GATES AND ELECTRODES FOR SELECTIVELY PASSING TONER

BACKGROUND OF THE INVENTION (1) Field of the Invention

The present invention relates to an image forming apparatus which forms images on a recording medium by causing a developer to jump thereto. It may be used for a printer unit in digital copiers and facsimile machines as well as for digital printers, plotters, and the like.

(2) Description of the Related Art

Recently, as the image forming means for outputting a visual image on recording medium such as paper etc., in response to an image signal, an image forming apparatus has been disclosed in Japanese Patent Application Laid-Open Hei 5 No. 134,581, for example, wherein charged particles are placed in an electric field so that they will jump by electric force to adhere to the recording medium whilst the potential to be applied to the control electrode having a number of passage holes located in the jump passage is being varied, to thereby form an image on the recording medium, directly.

In the above-mentioned related art, a method of controlling the developer is described, but the method suffers from many problems as shown below.

An image forming apparatus of a type of the above related art uses a control means for controlling the passage of charged particles through the gates. In the image forming apparatus of the type of the conventional art, jumping of the toner (developer), either the release or prohibition of the jumping, is controlled by regulating the electric field generated between the gates and the toner support while the strong electric field produced by the opposing electrode causes the toner to transfer to the surface of a paper as a recording medium and form an image thereon.

In the above-mentioned image forming apparatus, no charge having a polarity opposite to that of the toner will be given to the rearside of the recording medium, unlike the transfer process in the Carlson process. Therefore, when the recording medium slides on the metal disposed in its conveyance path, the charge on the toner constituting the image induces a very strong image force with respect to the metal. In this situation, a force acts on the toner on the recording medium in the direction opposite to the direction of movement of the recording medium, especially at the end portion of the metal. This causes the toner on the recording medium to move relatively from each other and form an image with a rubbed-like appearance, resulting in a disturbed developed image.

Further, in the image forming apparatus using plural colors of toner, this type of disturbance in the image causes color mixing of the multiple colors of toner, producing a new problem, that is, a failure in correct color reproduction.

SUMMARY OF THE INVENTION

The present invention has been achieved in view of the above problems and the present invention is configured as follows:

In accordance with the first aspect of the invention, an image forming apparatus includes:

a supplying means having at least one developer support each of which carries a developer of one kind of color;

an opposing electrode disposed facing the developer support;

a high-voltage power source for supplying a high voltage to produce a potential difference between the developer support and the opposing electrode;

a control electrode comprising an insulative substrate, a plurality of gates formed in the insulative substrate for forming the passage of the developer, and one or more electrodes provided around each of the gates, the control electrode being disposed between the developer support and the opposing electrode; and a control circuit for selectively applying multiple potential states to each of the electrodes around each of the gates, wherein the control circuit controls the passage of the developer through the gates by applying the predetermined voltage to desired electrodes so as to form an image on the surface of a recording medium which is being conveyed over the opposing electrode, and is characterized in that means for reducing the component of an electric force, acting on the developer particles residing on the recording medium, in the direction opposite to the direction of conveying the recording medium, is provided at the downstream side of the opposing electrode.

In accordance with the second aspect of the invention, the image forming apparatus having the above first feature is characterized in that the means for reducing is provided in such a manner that the downstream side portion of the opposing electrode, with respect to the direction of conveying the recording medium, becomes gradually spaced away from the path of the recording medium.

In accordance with the third aspect of the invention, the image forming apparatus having the above second feature is characterized in that a dielectric material is provided between the path of the recording medium and the portion of the opposing electrode which gradually becomes spaced away from the path of the recording medium.

In accordance with the fourth aspect of the invention, the image forming apparatus having the above first or second feature is characterized in that the means for reducing comprises a plurality of reducing structures correspondingly to individual developers having different characteristics and each reducing structure is different from each other.

In accordance with the fifth aspect of the invention, the image forming apparatus having the above fourth feature is characterized in that the means for reducing is adjusted so that an identical configuration can be used for all the reducing structures.

DESCRIPTION OF THE PREFERRED EMBODIMENTS

Figure 1:
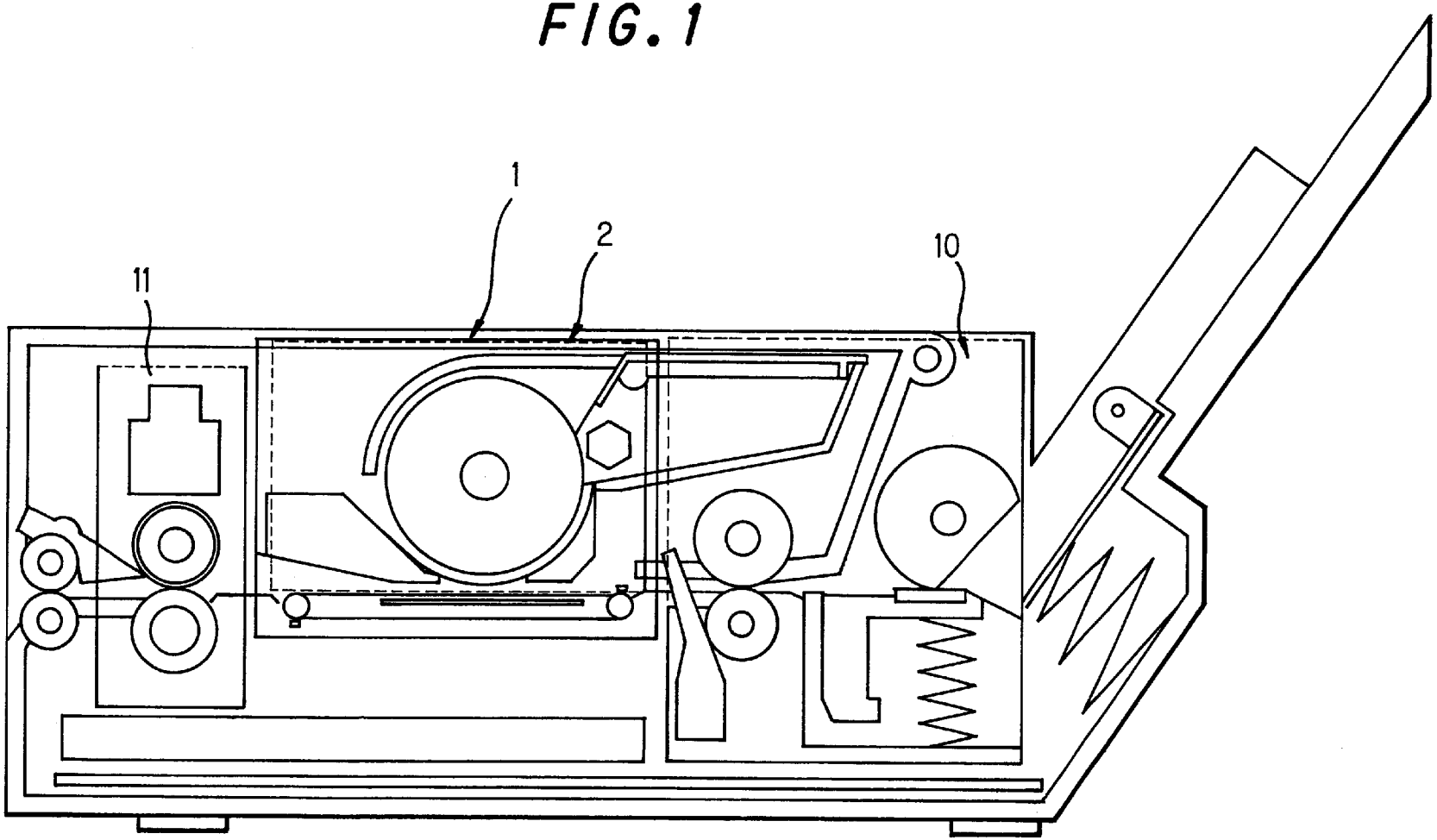
FIG. 1 is a schematic sectional view showing a printer having a printing portion in accordance with the embodiment of an image forming apparatus of the invention.
Figure 2:
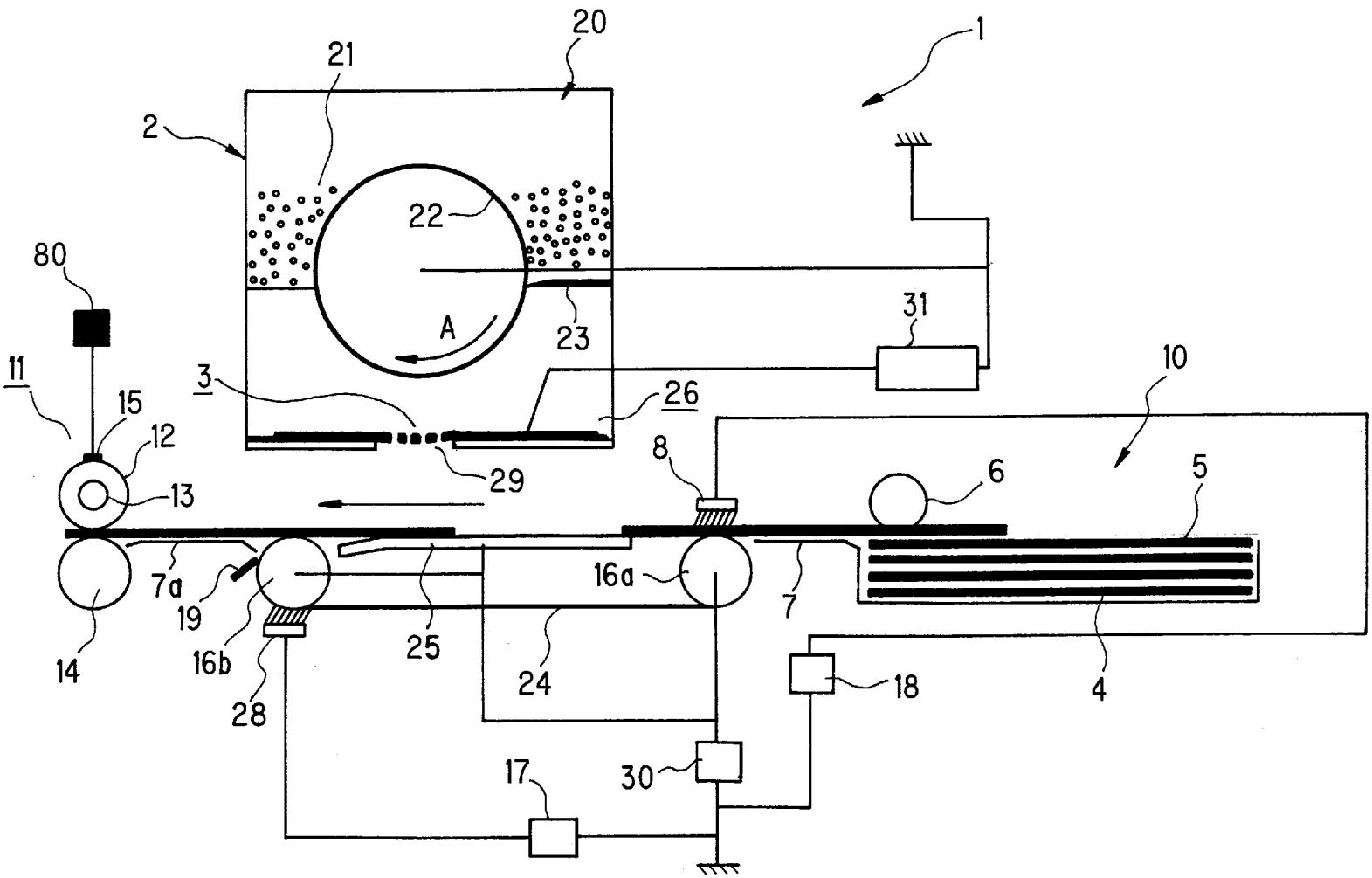
FIG. 2 is a sectional view showing the concept of the first embodiment of an image forming apparatus of the invention.

FIG. 1 is a section of a printer to which an image forming apparatus of the invention is built in, and FIG. 2 is an illustration for describing the features of the components. Reference numerals 1, 2, 10 and 11 in FIG. 1 are the same as those in FIG. 2, respectively.

In the following description, the image forming apparatus with a configuration for negatively charged toner (developer) will be described in detail, but the polarity of each voltage to be applied may be appropriately set if positive charged toner is used.

As shown in FIG. 2, an image forming unit 1 is composed of a toner supplying section 2 and a printing section 3. This image forming unit 1 creates a visual image in accordance with an image signal, onto a sheet of paper as recording medium with toner as the developer. In this image forming apparatus, the toner is made to jump and adhere onto the paper whilst the jumping of the toner is controlled based on an image forming signal so as to directly create an image on the paper.

A paper feeder 10 is provided on the input side of image forming unit 1 to which the paper is fed. Paper feeder 10 is composed of a paper cassette 4 for storing paper 5 as recording medium, a pickup roller 6 for delivering paper 5 from paper cassette 4, and a paper guide 7 for guiding fed paper 5. Paper feeder 10 further has unillustrated a paper feed sensors for detecting the feed of paper 5. Pickup roller 6 is rotationally driven by an unillustrated driving means.

Provided on the output side of image forming apparatus 1 from which the paper is output, is a fixing unit 11 for heating and pressing the toner image which was formed on paper 5 at the image forming unit 1, to fix it onto paper 5.

Fixing unit 11 is composed of a heat roller 12, a heater 13, a pressing roller 14, a temperature sensor 15, and a temperature controller circuit 80.

Heat roller 12 is made up of, for example, an aluminum pipe of 2 mm thick. Heater 13 is a halogen lamp, for example, which is incorporated in heat roller 12. Pressing roller 14 is made of e.g., silicone resin. Heat roller 12 and pressing roller 14 which are arranged opposite to each other, are pressed against one another in order to hold paper 5 in between and press it, with a pressing load, e.g. 2 kg, from unillustrated springs etc., provided at both ends of their shafts.

Temperature sensor 15 measures the surface temperature of heat roller 12. Temperature controller circuit 80 is controlled by a main controller which performs the on/off operation of heater 13 and other control based on the measurement of temperature sensor 15, thus maintaining the surface temperature of heater roller 12 at, for example, 150° C.

Fixing unit 11 has an unillustrated paper discharge sensor for detecting the discharge of paper 5.

The materials of heat roller 12, heater 13, pressing roller 14, etc., are not specifically limited. The surface temperature of heat roller 12 is not specifically limited either. Further, fixing unit 11 may use a fixing configuration in which paper 5 is either heated or pressed to fix the toner image.

Further, although it is not shown in the drawing, the paper output side of fixing unit 11 has a paper discharge roller for discharging paper 5 processed through fixing unit 11 onto a paper output tray and a paper output tray for holding paper 5 thus discharged. The aforementioned heat roller 12, pressing roller 14 and the paper discharge roller are rotated by an unillustrated driving means.

Toner supplying section 2 in image forming unit 1 is composed of a toner storage tank 20 for storing toner 21 as the developer, a toner support 22 of a cylindrical sleeve for supporting toner 21 and a doctor blade 23 for electrifying toner 21 and regulating the thickness of the toner layer carried on the peripheral surf ace of toner support 22. Doctor blade 23 is arranged on the upstream side with respect to the rotational direction of toner support 22, spaced with a distance of 60 $\mu$m, for example, from the peripheral surface of toner support 22. Toner 21 is of a non-magnetic type having a mean particle diameter of, for example, 10 $\mu$m, and is electrified with static charge of, for example, about −10 $\mu$C/g by doctor blade 23.

Here, the distance between doctor blade 23 and toner support 22 is not particularly limited. Also the mean particle size, the amount of static charge, etc., of toner 21 are not particularly limited.

Toner support 22 is rotationally driven by an unillustrated driving means in the direction indicated by arrow A in the figure, with its surface speed set at 80 mm/sec, for example, while toner support 22 is grounded. The rotational speed of toner support 22 is not particularly limited. Toner support 22 may be configured so as to support the toner by magnetic force, electric force or combination of electric and magnetic forces.

Printing section 3 in image forming unit 1 includes: an opposing electrode 25 which is made up of an aluminum sheet of, for example, 1 mm thick and faces the peripheral surface of toner support 22; a high-voltage power source 30 for supplying a high voltage to opposing electrode 25; control electrode 26 provided between opposing electrode 25 and toner support 22; a charge erasing brush 28; a charge erasing power source 17 for applying a charge erasing voltage to charge erasing brush 28; a charging brush 8 for charging paper 5; a charger power source 18 for supplying a charger voltage to charging brush 8; a dielectric belt 24; support members 16*a* and 16*b* for supporting dielectric belt 24; and a cleaner blade 19.

Opposing electrode 25 is arranged e.g., 1.1 mm apart from the peripheral surface of toner support 22. Dielectric belt 24 is made of PVDF as a base material, and is 75 μm thick with a volume resistivity of $10^{10}$ Ω·cm. Dielectric belt 24 is rotated by an unillustrated driving means in the direction of the arrow in the drawing, for example, at a surface speed of 30 mm/sec. Applied to opposing electrode 25 is a high voltage, e.g., 2.3 kV from high voltage power source (controlling means) 30. This high voltage supplied from high voltage power source 30 generates an electric field between opposing electrode 25 and toner support 22, required for causing toner 21 being supported on toner support 22 to jump toward opposing electrode 25.

Charge erasing brush 28 is pressed against dielectric belt 24 at a position downstream, relative to the rotational direction of dielectric belt 24, and of control electrode 26. Charge erasing brush 28 has an erasing potential of 2.5 kV applied from charge erasing power source 17 so as to eliminate unnecessary charges on the surface of dielectric belt 24.

If some toner 21 adhered to the surface of dielectric belt 24 due to a contingency such as paper jam, etc., cleaning blade 19 removes this toner 21 to prevent staining by toner 21 on the paper underside. The distance between opposing electrode 25 and toner support 22 is not particularly specified either. Further, the rotational speed of dielectric belt 24 or the voltage to be applied thereto is not particularly limited either.

Although unillustrated, the image forming apparatus includes: a main controller as a control circuit for controlling the whole image forming apparatus; an image processor for converting the obtained image data into a format of image data to be printed; an image memory for storage of the converted image data; and an image forming control unit for converting the image data obtained from the image processor into the image data to be given to control electrode 26.

The control electrode 26 is disposed in parallel to opposing electrode 25 and spreads two-dimensionally facing opposing electrode 25, and it has a structure to permit the toner to pass therethrough from toner support 22 to opposing electrode 25. The electric field formed around the surface of toner support 22 varies depending on the potential being applied to control electrode 26, so that the jumping of toner 21 from toner support 22 to opposing electrode 25 is controlled.

Figure 3:
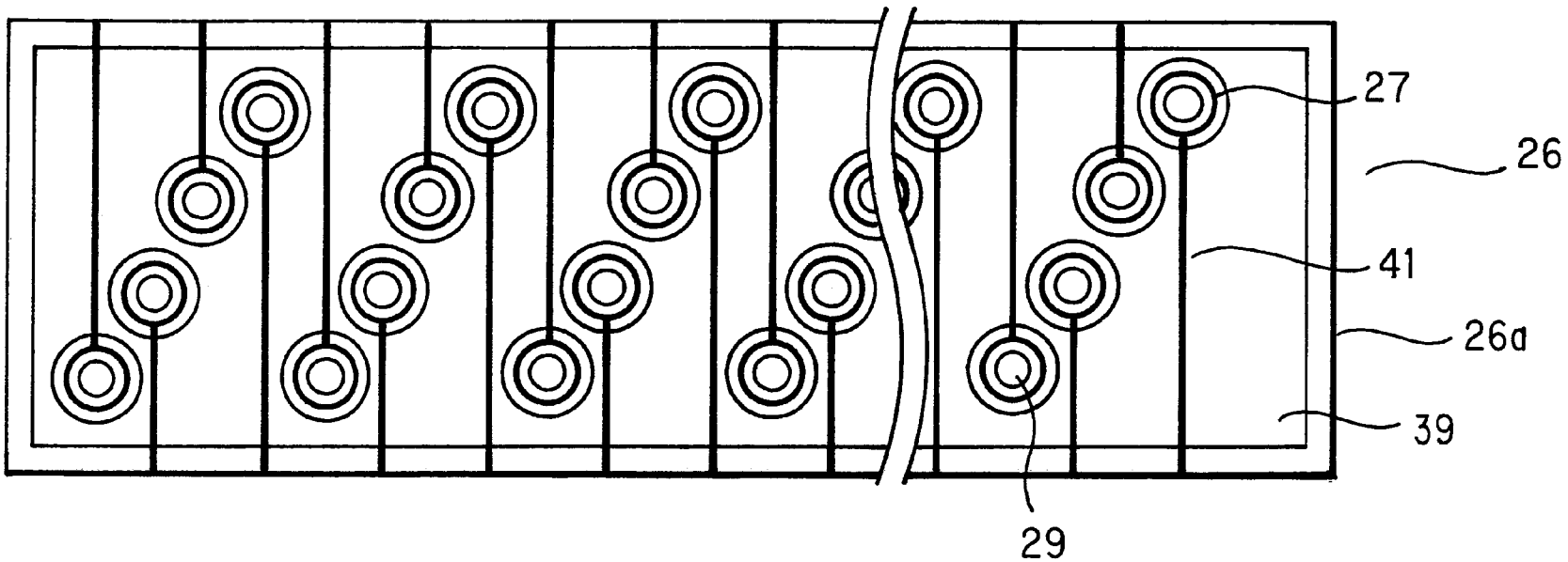
FIG. 3 is a plan view showing the control electrode of the first embodiment of an image forming apparatus of the invention.

The control electrode 26 is arranged so that its distance from the peripheral surface of toner support 22 is set at 100 μm, for example, and is secured by means of an unillustrated supporter member. As shown in FIG. 3, control electrode 26 is composed of an insulative board **26*a*, a high voltage driver (not shown), annular conductors independent of one another, i.e., annular electrodes 27. Board 26*a*** is made from a polyimide resin, for example, with a thickness of 25 μm.

Board **26*a* has holes forming gates 29, to be mentioned later, formed therein. Annular electrodes 27 are formed of copper foil of e.g., 18 μm thick and are arranged around the holes, in a predetermined layout. Each opening of the hole is formed with a diameter of 160 μm, for example, forming a passage for toner 21 to jump from toner support 22 to opposing electrode 25. This passage will be termed gate 29** hereinbelow.

Here, the distance between control electrode 26 and toner support 22 is not particularly limited. Each annular electrode 27 has an opening of 200 μm in opening diameter. The size of gates 29 and the materials and thickness of board **26*a* and annular electrodes 27** are not particularly limited.

Gates 29 or the holes in annular electrodes 27 are formed at, for example, 2,560 sites. Each annular electrode 27 is electrically connected to a control power source 31 shown in FIG. 2 via feeder line 41 and a high voltage driver (not shown).

The number of annular electrodes 27 is not particularly limited.

The surface of annular electrodes 27 as well as the surface of feeder lines 41 is coated with an insulative layer 39 of 30 μm thick, which ensures insulation between annular electrodes 27, insulation between feeder lines 41, insulation between annular electrodes 27 and feeder lines 41, which are not connected to each other, and insulation of them from toner support 22 and opposing electrode 25.

Supplied to annular electrodes 27 of control electrode 26 are voltages or pulses in accordance with the image signal from control power source (controlling means) 31 (shown in FIG. 2). Specifically, when toner 21 carried on toner support 22 is made to pass toward opposing electrode 25, a voltage, e.g., 150 V is applied (as the ON voltage, to be referred to hereinbelow as the same manner) to annular electrodes 27 from control power source 31. When the toner is blocked from passing, a voltage, e.g., −200 V is applied (as the OFF voltage, to be referred to hereinbelow as the same manner).

In this way, whilst the potential to be imparted to control electrode 26 is controlled in accordance with the image signal, a sheet of paper 5 is fed over opposing electrode 25 on the side thereof facing toner support 22. Thus, a toner image is formed on the surface of paper 5 in accordance with the image signal. Here, control power source 31 is controlled by a control electrode controlling signal transmitted from an unillustrated image forming control unit.

Figure 4:
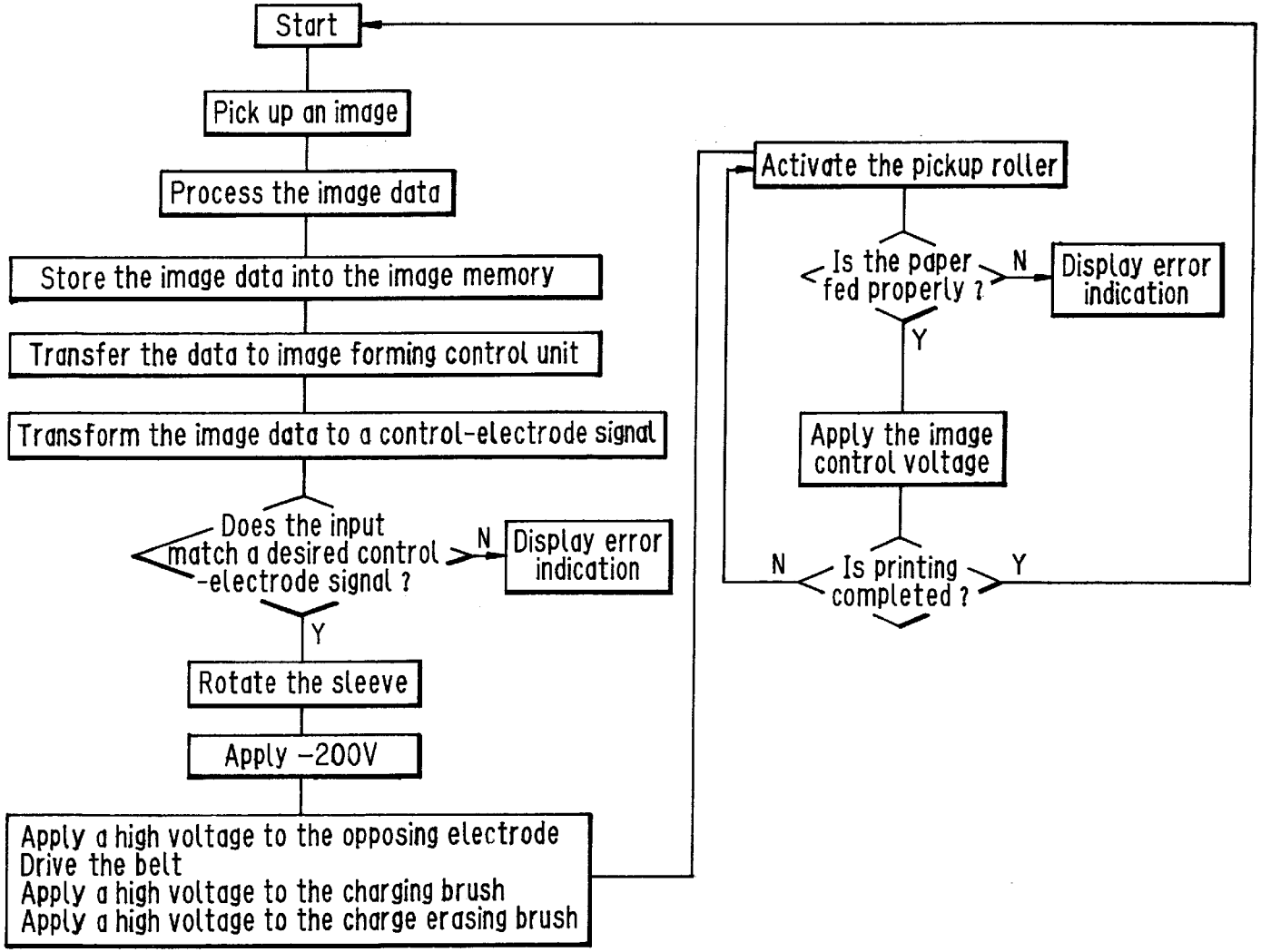
FIG. 4 is a flow chart for explaining the printing operation of an image forming apparatus of the invention.

The above image forming apparatus can be applied to an output printer for computers, word processors as well as the printing portion of digital copiers. Next, the image forming operation when the image forming apparatus is used as the printing portion of a digital copier will be described with reference to the flowchart shown in FIG. 4.

First, when the user operates the copy start key (not shown) with an original to be copied set on the image pickup section, the main controller which has received this input starts the image forming operation. More specifically, the image pickup section starts to read the image from the original. The image data is then processed in the image processor and is stored into the image memory. The image data thus stored in the image memory is then transferred to the image forming control unit where the input image data is converted into a control electrode controlling signal to be supplied to control electrode 26.

When the image forming control unit acquires a predetermined amount of the control electrode controlling signal, an unillustrated driving device starts its operation, which rotates pickup roller 6 shown in FIG. 2 to thereby deliver a sheet of paper 5 from paper cassette 4 toward image forming unit 1. At the same time, the paper feed sensor detects correct paper feed. Paper 5 delivered by pickup roller 6 is conveyed into and between charging brush 8 and support member **16*a*. Applied to support member 16*a* is a potential, from high-voltage power source 30, which is equal to that applied to opposing electrode 25. A charging potential of 1.2 kV is applied to charging brush 8 from charger power source 18. Paper 5 is charged with electricity from the potential difference between charging brush 8 and support member 16*a*, so it is statically attracted to dielectric belt 24. While the paper is attracted to dielectric belt 24, the paper is conveyed to the position where the belt 24 faces control electrode 26 in printing section 3 of image forming unit 1**. It should be noted that the predetermined amount of the control electrode controlling signal can be different depending upon the configuration of the image forming apparatus.

Then, the image forming control unit supplies the control electrode controlling signal to control power source 31. This control electrode controlling signal is supplied at a time synchronized with the feed of paper 5 to printing section 3 by charging brush 8. Control power source 31 controls the high voltage applied to each annular electrode 27 of control electrode 26, based on the control electrode controlling signal. Specifically, a voltage, either 150 V or −200 V, is applied from control power source 31, to annular electrodes 27, as appropriate so as to control the electric field around control electrode 26. In other words, the prohibition and release of jumping of toner 21 from toner support 22 to opposing electrode 25 is implemented as appropriate at each gate 29 of control electrode 26 in accordance with the image data. Thus, a toner image in accordance with the image signal is formed on paper 5 whilst it is moving at a speed of 30 mm/sec toward the paper output side by the advance of dielectric belt 24 over the surface of opposing electrode 25.

Paper 5 with a toner image formed thereon is separated from dielectric belt 24 by the curvature of support member 16*b* and is conveyed to fixing unit 11, where the toner image is fixed to paper 5. Paper 5 with a toner image fixed thereon is discharged by the discharge roller onto the paper output tray. At the same time, the fact that the paper is normally discharged is detected by the paper discharge sensor. From this detection, the main controller determines that the printing operation has been correctly completed.

By the image forming operation described above, a good image is created on paper 5. Since this image forming apparatus directly forms the image on paper 5, it is no longer necessary to use a developer medium such as photosensitive member, dielectric drum, etc., which were used in conventional image forming apparatuses. As a result, the transfer operation for transferring the image from the developer medium to paper 5 can be omitted, thus eliminating the degradation of the image and hence improving the reliability of the apparatus. Since the configuration of the apparatus can be simplified needing fewer parts, it is possible to reduce the apparatus in size and cost.

The image forming apparatus of the above first embodiment may be used as the printing portion of an output terminal for a computer or may be used as the printing portion of a digital copier. In either case, the method of the image forming operation itself has no difference from the other though the image signal to be processed and the way of signal exchange differ in each case.

As stated already, toner support 22 is grounded (see FIG. 2) while opposing electrode 25 and support member 16*a* have a high voltage of 2.3 kV applied and charging brush 8 has a high voltage of 1.2 kV applied. As a result, negative charge is supplied to the surface of paper 5 fed between charging brush 8 and dielectric belt 24, by the potential difference between charging brush 8 and support member 16*a*. As supplied with negative charge, paper 5 is attracted to dielectric belt 24 by the static electric force of the charge and is conveyed to directly below gates 29 as dielectric belt 24 moves. The charge on the surface of dielectric belt 24 dissipates, hence, when it reaches directly below gates 29 the paper will have a surface potential of 2 kV due to the equilibrium with the potential of opposing electrode 25.

In this condition, in order for toner 21 carried on toner support 22 to pass toward opposing electrode 25, control power source 31 applies a voltage of 150 V to annular electrodes 27 of control electrode 26. When toner 21 needs to be stopped passing through gates 29, a voltage of −200 V is applied.

In this way, with paper 5 being attracted to dielectric belt 24, the image is directly formed on the surface of paper 5.

In the above description, the voltage applied to annular electrodes 27 of control electrode 26 for allowing passage of toner 21 was set at 150 V as an example. This voltage, however, is not specifically limited as long as the jumping control of toner 21 can be performed as desired. Similarly, the voltage applied to opposing electrode 25, the voltage applied to charging brush 8 and the surface potential of paper 5 directly below gates 29 are not particularly limited as long as the jumping control of toner 21 can be performed as desired.

The voltage to be imparted to annular electrodes 27 of control electrode 26 to prevent passage of toner 21 should not be particularly limited as long as it does not depart from the scope of the invention.

Figure 5:
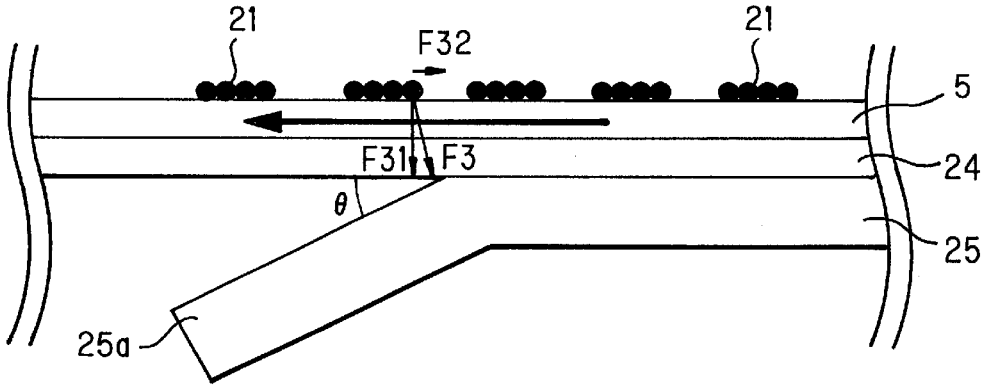
FIG. 5 is a plan view showing the opposing electrode of the first embodiment of an image forming apparatus of the invention.

Further description will be added as to the image forming apparatus of the above first embodiment. FIG. 5 is an enlarged view showing opposing electrode 25 used for this embodiment, at its downstream side with respect to conveyed direction of paper 5. In the first embodiment, opposing electrode 25 has a slanted portion 25*a* which is slanted on the downstream side thereof so as to make a predetermined deflection angle θ relative to the conveyed direction of paper 5 in FIG. 5 and functions as a reducing means of the invention.

Figure 6:
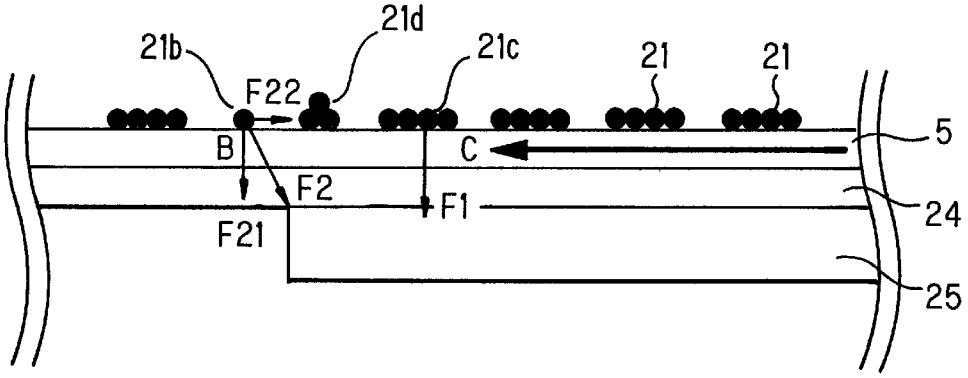
FIG. 6 PRIOR ART
FIG. 6 is a sectional view showing the adhering state of the toner to the control electrode in a conventional image forming apparatus.

FIG. 6 shows a conventional configuration of an image forming apparatus, which is compared to the configuration of FIG. 5. As paper 5 moves in the direction of the arrow C, a toner particle 21*b*, for example, on paper 5 receives an electric force F2 that acts in the direction of arrow B in the figure, at the edge of opposing electrode 25 in FIG. 6. This electric force F2 can be decomposed into force components F21 and F22, which act perpendicularly to paper 5 and in the direction opposite to the conveying direction of paper 5, respectively. Since force component F21, acting on toner particle 21*b*, which is normal to paper 5 is less than electric force F1 which acts on a toner particle 21*c*, for example, residing over opposing electrode 25 (F21<F1) and in addition an extra force component F22 acts on toner particle 21*b*, toner 21 on paper 5 tends to move or shift in the direction of F22 forming a concentration of toner 21 as shown by toner particles 21*d* and/or a rubbed image due to the movement of toner 21, readily causing degradation of the image in various forms.

In contrast, in the first embodiment shown above, opposing electrode 25 is provided with a slanted portion 25*a* deflected at an angle of θ=25 with respect to the conveying direction of paper 5, as shown in FIG. 5. As a result, an electric force F3 arises in place of electric force F2 shown in FIG. 6, but its force component F32 is much smaller as compared to force component F22 shown in FIG. 6. For this reason, neither moving nor shifting of toner particles 21*d* and 21 as shown in FIG. 6, will arise, and hence no image degradation stemming from these causes arises either.

The first embodiment was confirmed to be effective in avoiding the above drawbacks if the deflected angle θ was set at not greater than 50° (≦θ50°). Accordingly, this angle may be set at 45° (θ=45°) instead of θ=25° as specified in the first embodiment, or can be determined as appropriate based on the apparatus configuration, the process stability, and the like.

Although opposing electrode 25 in the above first embodiment has a bent portion, the shape of opposing electrode 25 should not be limited to this as long as it can avoid the above drawbacks. For example, the opposing electrode may have configurations as shown in FIGS. 7 through 9.

Figure 7:
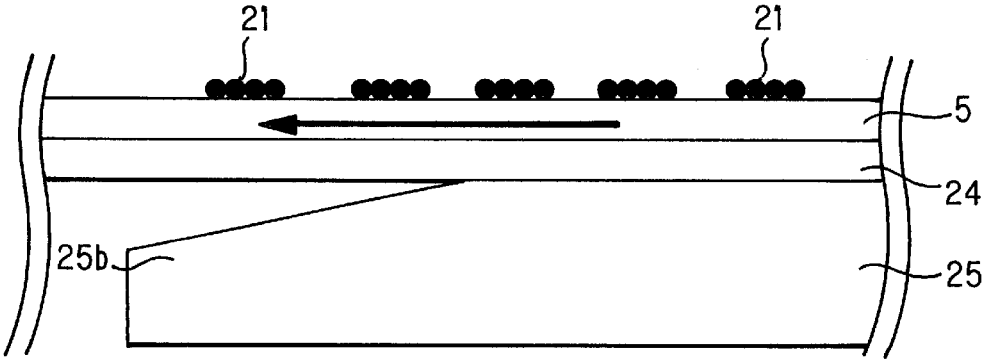
FIG. 7 is a sectional view showing the opposing electrode of the second embodiment of an image forming apparatus of the invention.
Figure 8A:
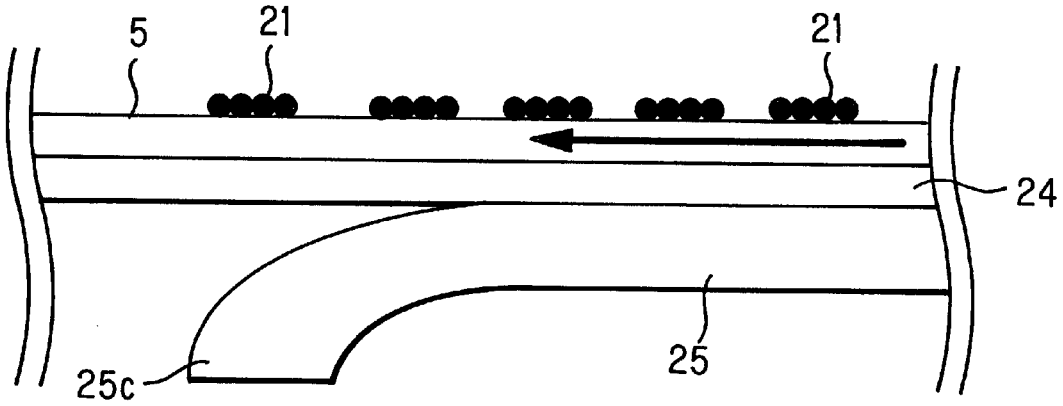
FIG. 8A is a sectional view showing a first example of the opposing electrode of the third embodiment of an image forming apparatus of the invention.
Figure 8B:
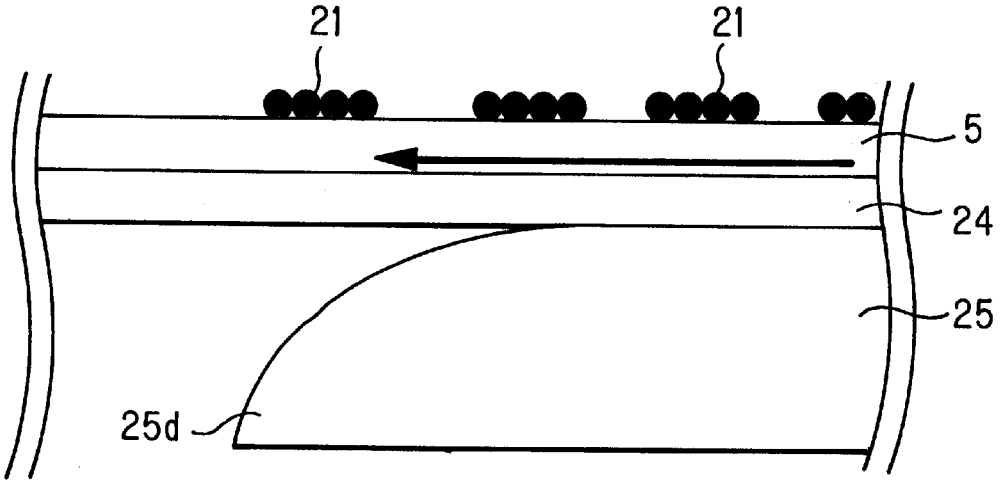
FIG. 8B is sectional view showing a second example of the opposing electrode of the third embodiment of an image forming apparatus of the invention.

In the second embodiment shown in FIG. 7, a part of opposing electrode 25 is beveled so as to form a slanted portion 25*b* equivalent to that of FIG. 5. Other than this, as in the third embodiment shown in FIG. 8A, the opposing electrode 25 may be curved so as to provide a curved portion 25*c* which will gradually become spaced away with respect to the conveying direction of the paper 5. Alternatively, as shown in FIG. 8B, the opposing electrode 25 may be beveled so that part of it is shaped with a curving surface, i.e., curved portion 25*d*. In short, the structure of opposing electrode 25 may be adjusted adaptively depending upon the apparatus configuration, the material used for opposing electrode 25, and the like.

Figure 9A:
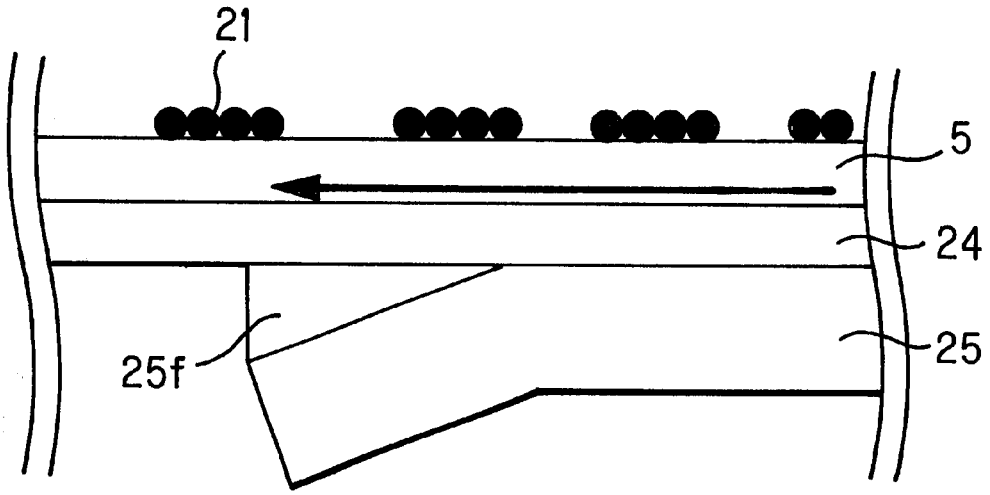
FIG. 9A is a sectional view showing a first example of the opposing electrode of the fourth embodiment of an image forming apparatus of the invention.
Figure 9B:
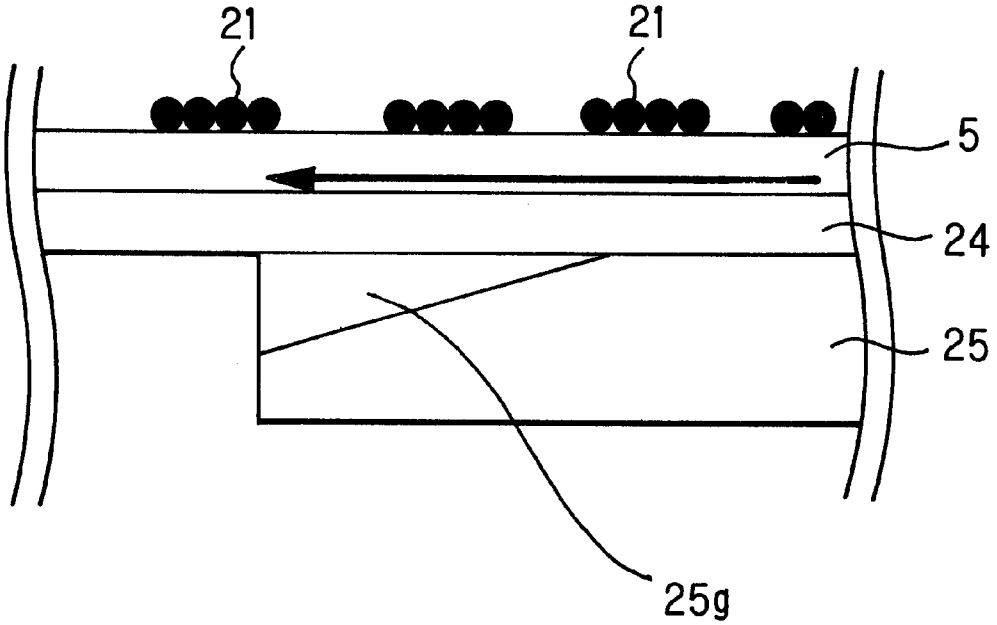
FIG. 9B is a sectional view showing a second example of the opposing electrode of the fourth embodiment of an image forming apparatus of the invention.

In the above description, a slanted portion was exemplified as the reducing means for reducing the force component which will be derived from the image force induced by toner 21 and will act on toner 21 in the direction opposite to the conveying direction of paper 5. However, the invention can be realized by various configurations, without being limited to the above configurations. For example, FIGS. 9A and 9B show the fourth embodiment. In FIG. 9A, a dielectric material 25*f* may be provided in the slanted portion of opposing electrode 25. It is also possible to provide a dielectric material 25*g* in opposing electrode 25 of FIG. 7, as shown in FIG. 9B. Other than these, instead of metal, opposing electrode 25 may be formed with a conductive resin, for example, and adjusting the dielectric constant of the edge part so as to avoid the above drawbacks.

As described above the dielectric layer used for reducing means is not only effective in reducing the force component in the direction opposite to the direction of conveying of paper 5, but is also effective in avoiding or reducing a discharge upon separation which is liable to occur under these circumstances, or reducing the discharge upon separation even when it occurs, thereby a new effect is brought about and the degradation of images due to the discharge upon separation can be avoided.

Figure 10:
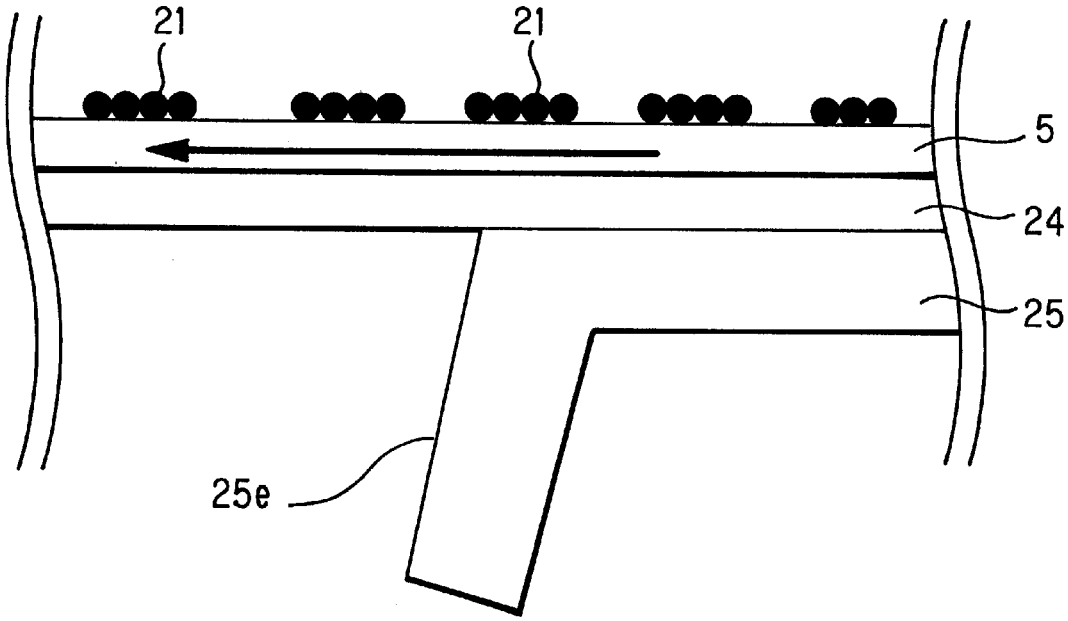
FIG. 10 is a sectional view showing an inappropriate example to be compared with the image forming apparatus of the invention.

In the above embodiments, it is preferred that the angle of the slanted portion or the curvature of the curving surface formed on opposing electrode 25 is not large as shown with a slanted portion 25*e* in FIG. 10 because this configuration easily causes the aforementioned problems. Therefore, the angle of the slanted portion or the curvature of the curved surface, the dielectric constant and thickness of the dielectric layer for the reducing means should be determined appropriately depending upon, for example, the charge amount of toner 21 to be used, the conveying speed of paper 5 and the like, in order to successfully avoid the above drawbacks.

Further, in the above embodiment, the slanted portion or the curved portion is provided for opposing electrode 25, but the location of provision of the slanted portion or the curved portion should not be limited to opposing electrode 25. It can be provided for any metal or conductive portion, for example, paper guide 7*a* (shown in FIG. 2), which resides in the path of paper 5 after printing to fixing unit 11 (shown in FIG. 2). The reference numeral 24 in FIGS. 5, 6,7, 8A, 8B, 9A, 9B and 10 designated dielectric Belt.

Control electrode 26 is not limited to the one described above. So the present invention can be applied to image forming apparatuses having various configurations of the control electrode akin to the above one.

Figure 11:
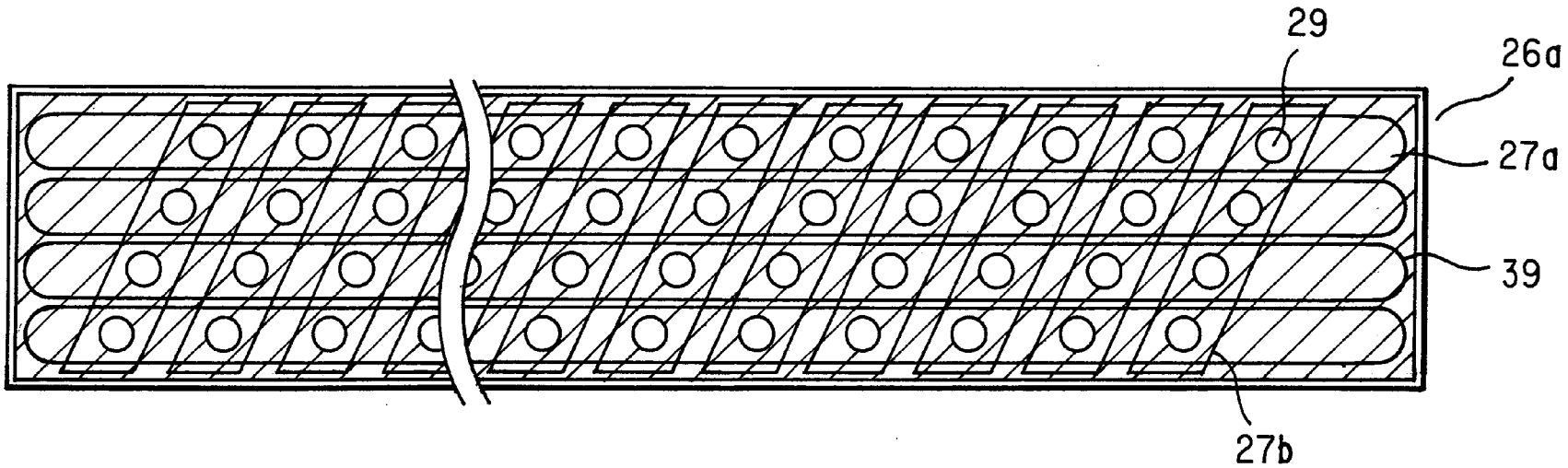
FIG. 11 is a plan view showing another embodiment of the control electrode of an image forming apparatus of the invention.

For example, in the above description of the embodiments, the jumping control of toner 21 through gates 29 was described referring to a case of control electrode 26 of a single drive form in which each gate 29 is controlled by a single electrode. However, the present invention can be applied to the case where a control electrode 26*a* in a matrix drive form as shown in FIG. 11 is used, with a beneficial result of image forming. In FIG. 11, strip-like electrode groups 27*a* and 27*b* are provided in place of annular electrodes 27. Control electrode 26 has strip-like electrodes 27*b* on the side facing toner support 22 and also has strip-like electrodes 27*a* on the side facing opposing electrode 25.

In the case of control electrode 26*a* shown in FIG. 11, the number of FETs used for the switching means for switching the application voltage to each gate 29 can be markedly reduced. For example, the number of FETs required for control electrode 26*a* shown in FIG. 11 is reduced by about one-fourth as compared to that required for control electrode 26 shown in FIG. 3. In this way, in view of reducing the number of FETs in use, the control electrode 26*a* shown in FIG. 11 is markedly effective. Further, in FIG. 11, a shield electrode 39 of a single sheet is provided, but the invention is not limited to this. For example, shield electrode 39 may be of multiple parts, or alternatively, the control electrode may be configured without any shield electrode.

The voltage to be applied to the above shield electrode 39 may be always set at a constant level. Or, the voltage to be applied to shield electrode 39 may be controlled by switching it in synchronization with the voltage application to annular electrodes 27 or the like for jumping control of toner 21.

In the above embodiments, control electrode 26 is attached in a curved form as shown in FIG. 2, but the attachment of control electrode 26 is not limited to this. That is, the control electrode may be attached in a flat form.

The above drawbacks were discussed referring to a case of a monochrome image forming apparatus, but they become more distinct in the case of a color image forming apparatus.

Figure 12:
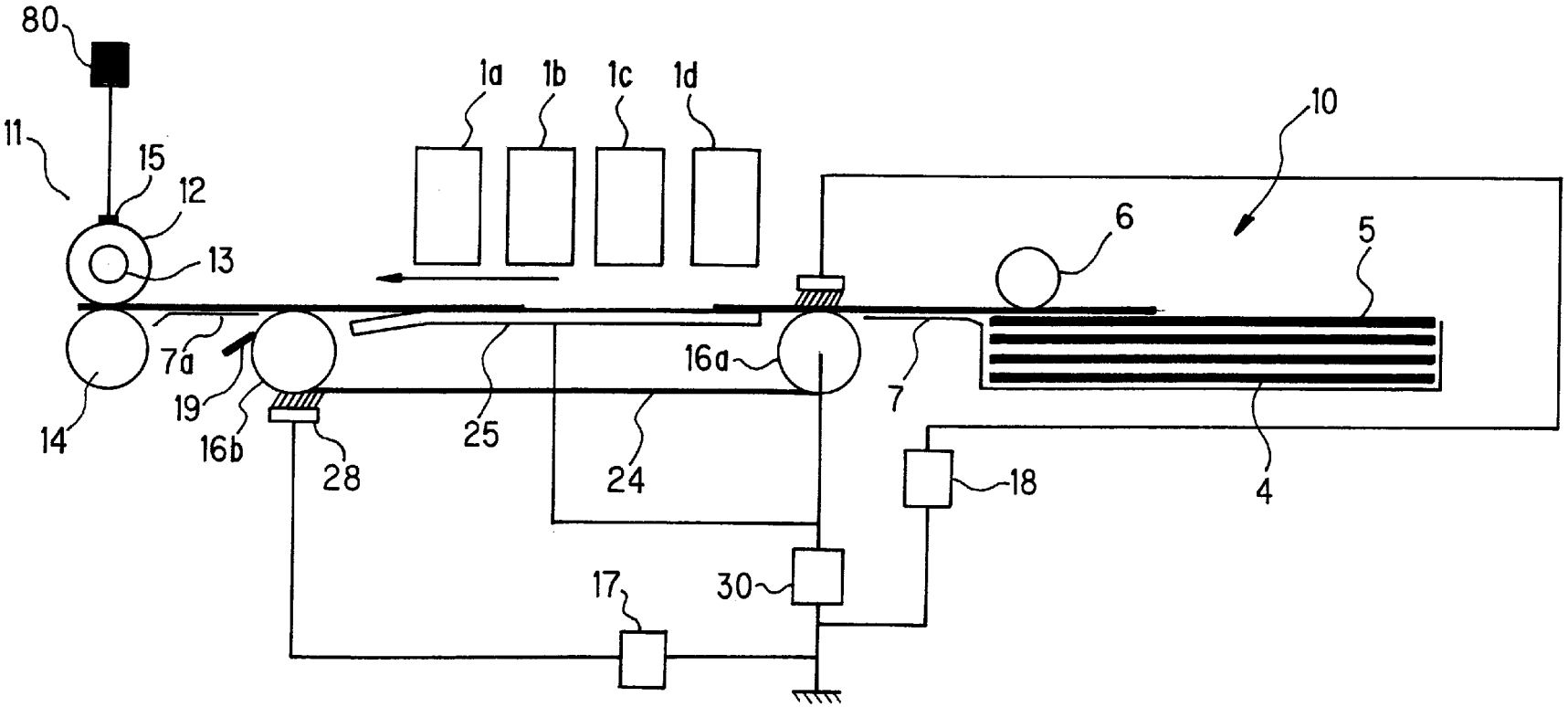
FIG. 12 is a sectional view showing an embodiment of a color image forming apparatus to which an image forming apparatus of the invention is applied.

For example, a color image forming apparatus may be configured by providing a plurality of image forming units 1*a*, 1*b*, 1*c* and 1*d* made up of plural toner supplying sections and printing sections wherein the toner supplying sections are filled with color toners, e.g., yellow, magenta, cyan and black, as shown in FIG. 12. In FIG. 12, image forming units 1*a*, 1*b* 1*c* and 1*d* corresponding to yellow, magenta, cyan and black, to each of which the present invention is applied, are provided and color images are formed in accordance with image data of respective colors. The other components may be the same as those in FIG. 2. In accordance with the invention, the above drawbacks will never arise, hence it is possible to realize beneficial color image forming with desired reproduction of colors. The reference numerals 4, 6, 7, 7*a*, 10, 11, 12, 13, 14, 15, 16*a*, 16*b*, 17, 18, 19, 24, 28, 30 and 80 indicate the parts of the corresponding reference numerals in FIG. 2.

Figure 13:
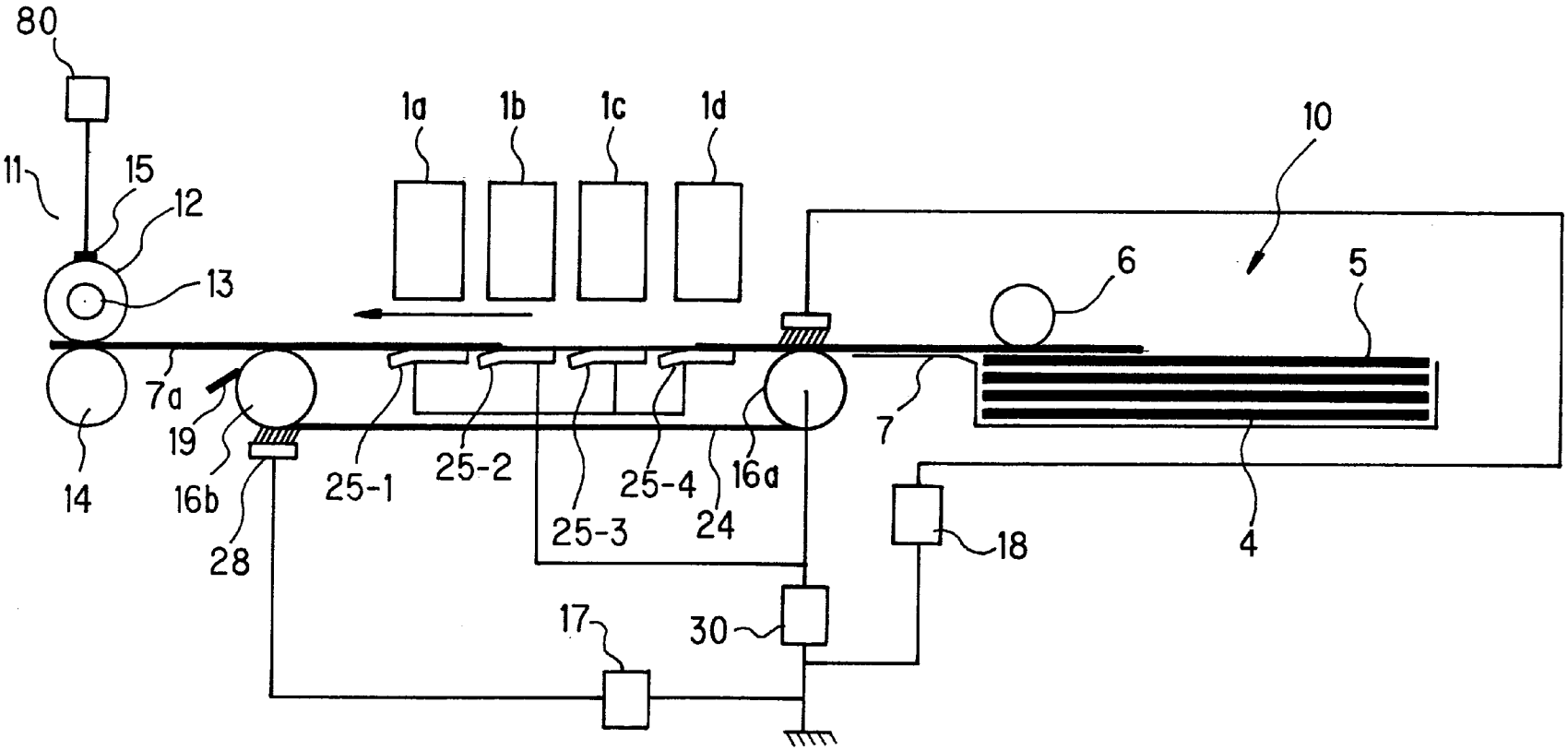
FIG. 13 is a sectional view showing another embodiment of a color image forming apparatus to which an image forming apparatus of the invention is applied.

Further, in the case of a color image forming apparatus in which multiple types of toner are provided, a configuration, as shown in FIG. 13, having a multiple number of opposing electrodes 25-1, 25-2, 25-3 and 25-4 corresponding to each type of toner 21 may be considered. In such a configuration, each type of toner 21 may have a different characteristic from the others and will need a different slanted portion. Accordingly, the slanted portion provided for opposing electrode 25-1, 25-2, 25-3 and 25-4 in each image forming unit can be different from the others, depending upon the individual type of toner 21. In this case, it is considered that the angle of each slanted portion, corresponding to the angle θ in FIG. 5, of opposing electrode 25-1, 25-2, 25-3 and 25-4 in each image forming unit may be adjusted adaptively so that each angle of the slanted portion differs from the others.

In this case, since the angle of each slanted portion differs from another depending upon the characteristics of toner 21 used, the number of parts increases. In this case, the following configuration is further preferable. For example, suppose that θ1 represents the maximum deflection angle, corresponding to the angle θ in FIG. 5, required for image forming unit 1*a* of the deflected portion, θ2 represents that for image forming unit 1*b*, θ3 and θ4 represent those for image forming units 1*c* and 1*d*, respectively, it is possible to provide a configuration in which each deflection angle θ is set identically so that it meets the relation θ≦θn (n=1, 2, 3 and 4). For example, in the above embodiment if θ1≦47°, θ2≦40°, θ3≦35° and θ4≦51°, then the slanted portion in each image forming unit may be formed with an angle θ≦35°. Thus, it is possible to set the slanted portion at a constant angle, while still obtaining the advantages of the invention. In this way, multiple number of opposing electrodes 25 can be configured with an identical structure, so that it is possible to reduce the number of parts, the size and cost as well as to improve the reliability.

In the example with reference to FIG. 12, the configuration of opposing electrode 25 has a slanted portion, but various configurations including the aforementioned configurations with curvature or a curved surface can be considered. The reference numerals 4, 6, 7, 7*a*, 10, 11, 12, 13, 14, 15, 16*a*, 16*b*, 17, 18, 19, 24, 28, 30 and 80 indicate the parts of the corresponding reference numerals in FIG. 2.

In the above embodiments, paper 5 is attracted to opposing electrode 25-1, 25-2, 25-3 and 25-4 by utilizing electrostatic force. But the attracting method for conveyance is not limited to this only. There are various conveying methods such as air suctioning conveyance and the like.

In the description of the embodiments, an example where toner is used as the developer was explained, but ink, and the like, can be used as the developer. It is also possible to construct toner supplying section 2 with a structure using an ion flow process. Specifically, the image forming unit may include an ion source such a corona charger or the like. Also in this case, it is possible to provide the same operations and effects as stated above.

The image forming apparatus in accordance with the invention can be preferably applied to the printing unit in digital copiers, facsimile machines as well as to digital printers, plotters, etc.

In accordance with the image forming apparatus having the first or second feature, no or very slight force in the direction opposite to the direction of conveying the recording medium acts on the developer residing on the recording medium when the recording medium departs from an electrode such as the opposing electrode or the like. Therefore, the developer on the recording medium will not move or displace, so that image degradation will not occur during the conveyance of the recording medium.

In accordance with the image forming apparatus of the third feature, since a dielectric layer is provided at the portion where the recording medium is separated from the electrode, it is possible to prevent or reduce the occurrence of a discharge upon separation, and hence it is possible to avoid or reduce image degradation due to a discharge upon separation.

In accordance with the image forming apparatus of the fourth feature, since a different setup can be provided for each developer, each having diverse characteristics, it is possible to realize a beneficial color image forming apparatus free from image degradation for all colors of developers.

In accordance with the image forming apparatus of the fifth feature, since an identical structure for the means for reducing can be used for all the image forming units, there is no need to form plural reducing structures. So the means for reducing can be simplified, thus reducing the number of parts and hence the size and cost of the machine as well as improving the reliability.

What is claimed is:

1. An image forming apparatus comprising:

a supply device including at least one developer support associated with a source of particle developer material of one kind of color and/or characteristics, each of said at least one developer support defining a surface adapted to carry developer material of the kind of color and/or characteristics contained in its associated source;

at least one element defining a non-moving, opposing electrode configuration disposed facing the at least one developer support;

a high-voltage power source for supplying a high voltage to produce a potential difference between the at least one developer support and the opposing electrode configuration;

a control electrode comprising an insulative substrate, a plurality of gates extending substantially transversely through the substrate, and one or more electrodes provided around each of the gates, the control electrode being disposed between the at least one developer support and the opposing electrode configuration;

a conveyor belt for conveying a recording medium in a selected direction along a substantially planar path between the opposing electrode configuration and the control electrode; and a control circuit for selectively applying predetermined voltages to each of the electrodes around the gates to create electrical potential states in the gates controlling the passage of developer material through the gates so as to form a predetermined image on a surface of the recording medium as it is conveyed between the opposing electrode configuration and the control electrode, characterized by reducing means for reducing a component of the electric force acting on the developer material after the disposition thereof onto the surface of the recording medium in a direction opposite to the selected direction of conveying the recording medium, said reducing means being provided at a downstream side of each of the at least one element of the opposing electrode configuration, and said reducing means being such that a downstream side of each of the at least one element of the opposing electrode configuration includes a portion that slants away from the supply device at an angle with respect to the selected direction so as to become Gradually increasingly spaced away from the conveying belt.

2. The image forming apparatus according to claim 1, wherein the reducing means is provided in such a manner that the downstream side portion of each of the at least one element of the opposing electrode, with respect to the selected direction becomes gradually spaced away from the planar path of the recording medium through said apparatus.

3. The image forming apparatus according to claim 2, wherein a dielectric material is provided between the path of the recording medium and the portions of the at least one element of the opposing electrode configuration which gradually become spaced away from the path of the recording medium.

4. The image forming apparatus according to claim 1 or 2, wherein the reducing means comprises a plurality of reducing structures corresponding to each individual kind of color and or characteristic developer material, and each reducing structure is different from the other reducing structures.

5. The image forming apparatus according to claim 1 or 2, wherein the reducing means comprises a plurality of reducing structures corresponding to each kind of color and/or characteristic developer material, and the angle of each slanted portion is the same.

* * * * *